US006138529A

United States Patent [19]

Pietras

[11] Patent Number: 6,138,529

[45] Date of Patent: Oct. 31, 2000

[54] APPARATUS FOR GRIPPING A TUBULAR MEMBER

[75] Inventor: Bernd-Georg Pietras, Wedemark, Germany

[73] Assignee: Weatherford/Lamb, Inc., Houston, Tex.

[21] Appl. No.: 09/355,768

[22] PCT Filed: Feb. 4, 1998

[86] PCT No.: PCT/GB98/00350

§ 371 Date: Aug. 4, 1999

§ 102(e) Date: Aug. 4, 1999

[87] PCT Pub. No.: WO98/35128

PCT Pub. Date: Aug. 13, 1998

[30] Foreign Application Priority Data

Feb. 7, 1997 [GB] United Kingdom ..... 9702532

[51] Int. Cl.[7] ..... E21B 19/16

[52] U.S. Cl. ..... 81/57.33; 81/57.34

[58] Field of Search ..... 81/57.16–57.18, 81/57.2, 57.33, 57.34

[56] References Cited

U.S. PATENT DOCUMENTS

| | | | |
|---|---|---|---|
| 2,536,458 | 1/1951 | Munsinger . | |
| 2,544,639 | 3/1951 | Calhoun | 81/57.16 |
| 2,615,681 | 10/1952 | True . | |
| 2,618,468 | 11/1952 | Lundeen . | |
| 2,784,626 | 3/1957 | Paget . | |
| 2,985,455 | 5/1961 | Powell | 279/4 |
| 3,021,739 | 2/1962 | Grundmann | 81/53 |
| 3,023,651 | 3/1962 | Wallace | 81/57 |
| 3,522,966 | 8/1970 | Wood | 294/110 |
| 3,760,658 | 9/1973 | Guier | 81/57.34 |
| 3,892,140 | 7/1975 | Fox et al. | 74/224 |
| 3,937,514 | 2/1976 | Langowski | 294/88 |
| 3,937,515 | 2/1976 | Langowski | 294/88 |
| 3,982,449 | 9/1976 | Choate, Jr. | 81/57.18 |
| 4,079,640 | 3/1978 | Golden | 81/57.17 |
| 4,082,017 | 4/1978 | Eckel | 81/57.16 |
| 4,192,206 | 3/1980 | Schulze-Beckinghausen | 81/57.18 |
| 4,200,010 | 4/1980 | Hewitt | 81/57.16 |
| 4,273,010 | 6/1981 | Farr et al. | 81/57.18 |
| 4,304,433 | 12/1981 | Langowski | 294/106 |
| 4,346,629 | 8/1982 | Kinzbach | 81/57.2 |
| 4,402,239 | 9/1983 | Mooney | 81/57.16 |
| 4,574,664 | 3/1986 | Curvy | 81/57.34 |

(List continued on next page.)

FOREIGN PATENT DOCUMENTS

| | | | |
|---|---|---|---|
| 480401 | 1/1952 | Canada | 81/57.17 |
| 0166675 | 6/1984 | European Pat. Off. | E21B 19/16 |
| 0261924 | 9/1986 | European Pat. Off. | E21B 19/16 |
| 2305878 | 4/1997 | United Kingdom | E21B 19/16 |
| WO 9717171 | 5/1997 | WIPO | B24B 13/50 |

OTHER PUBLICATIONS

"Clincher," Superior Manufacturing & Hydraulics, 1997.

*Primary Examiner*—David A. Scherbel
*Assistant Examiner*—Anthony Ojini
*Attorney, Agent, or Firm*—Guy McClung

[57] ABSTRACT

An apparatus for gripping a tubular member (118) comprising a housing (101) having an opening (119) for receiving a tubular member (118), at least one passive jaw (102, 103) pivotally mounted on said housing (101) and pivotable between a first position in which said tubular member (118) can enter said apparatus (100) via said opening (119) and a second position in which exit of said tubular (118) from said apparatus (100) is inhibited, an arm (112, 113) displaceable to prevent said passive jaw (102) pivoting to its first position, an active jaw (115) displaceable into engagement with said tubular member (118), and means (114) which act between said active jaw (115) and said arm (112) so that, in use, when a tubular member (188) is in said apparatus (100) and said active jaw (115) is advanced towards said tubular member (118) said arm (112) is displaced to prevent said passive jaw (102) moving to its first position before said active jaw (115) engages said tubular (118).

7 Claims, 2 Drawing Sheets

U.S. PATENT DOCUMENTS

Figure 1:
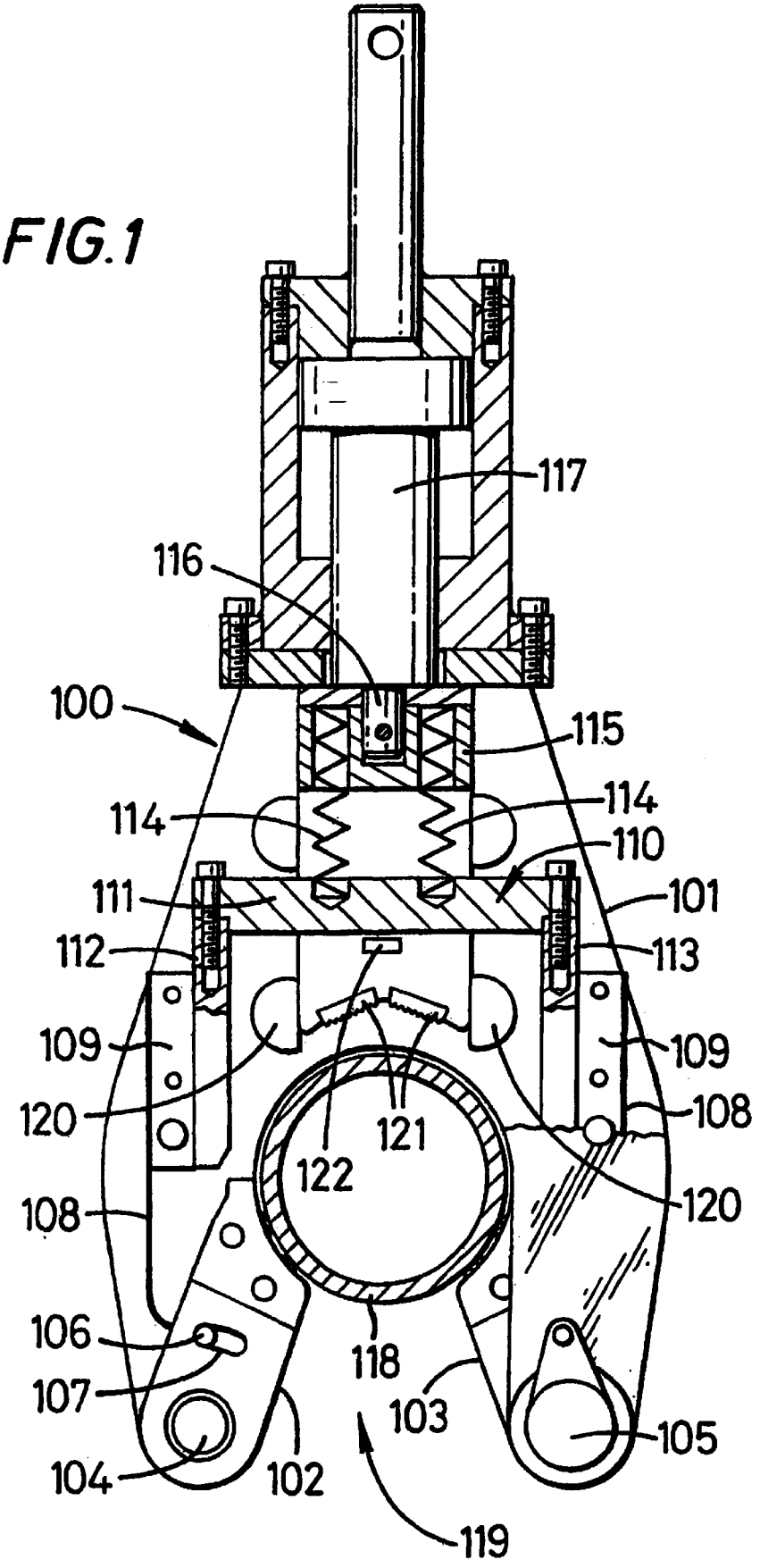

| | | | |
|---|---|---|---|
| 4,716,811 | 1/1988 | Johnson | 89/40.12 |
| 4,811,635 | 3/1989 | Falgout, Sr. | 81/57.33 |
| 5,060,542 | 10/1991 | Hauk | 81/57.34 |
| 5,386,746 | 2/1995 | Hauk | 81/57.34 |
| 5,537,900 | 7/1996 | Schaar | 81/57.33 |
| 5,669,653 | 9/1997 | Pennisson | 294/116 |
| 5,671,961 | 9/1997 | Buck | 294/116 |
| 5,740,702 | 4/1998 | Smith | 81/57.33 |
| 5,791,206 | 8/1998 | Daigle et al. | 81/57.33 |
| 5,842,390 | 12/1998 | Bouligny et al. | 81/57.34 |

APPARATUS FOR GRIPPING A TUBULAR MEMBER

This invention relates to an apparatus for gripping a tubular member.

During the construction of oil and gas wells it is necessary to connect and disconnect a large number of tubular members. A great many devices have been developed for this purpose. However, there is still a need for an inexpensive, reliable and quick apparatus particularly for those areas of the world where skilled technical labour is often not readily available.

It is believed that preferred embodiments of the present invention will help satisfy this need.

According to the present invention there is provided an apparatus for gripping a tubular member, which apparatus comprises a housing having an opening for receiving a tubular member, characterised in that said apparatus further comprises at least one passive jaw pivotally mounted on said housing and pivotable between a first position in which said tubular member can enter said apparatus via said opening and a second position in which exit of said tubular from said apparatus is inhibited, an arm displaceable to prevent said passive jaw pivoting to its first position, an active jaw displaceable into engagement with said tubular member, and means which act between said active jaw and said arm so that, in use, when a tubular member is in said apparatus and said active jaw is advanced towards said tubular member said arm is displaced to prevent said passive jaw moving to its first position before said active jaw engages said tubular.

Preferably, said apparatus includes means to bias said passive jaw towards said second position.

Advantageously, said apparatus includes a pin on one of said housing and said passive jaw, and an elongate slot in the other of said housing and said passive jaw, said pin projecting into said elongate slot and co-operating therewith to limit movement of said passive jaw relative to said housing.

Preferably, said apparatus includes two passive jaws pivotally mounted on said housing on opposite sides of said opening, each passive jaw being pivotable between a first position in which said tubular member can enter said apparatus via said opening and a second position in which exit of said tubular member from said apparatus is inhibited, an arm associated with each passive jaw and displaceable to prevent its passive jaw pivoting to its first position.

Advantageously, said arms form part of a yoke.

Preferably, said means which act between said active jaw and said arms comprise at least one spring.

Advantageously, said apparatus includes a hydraulic piston and cylinder to displace said active jaw.

Figure 2:
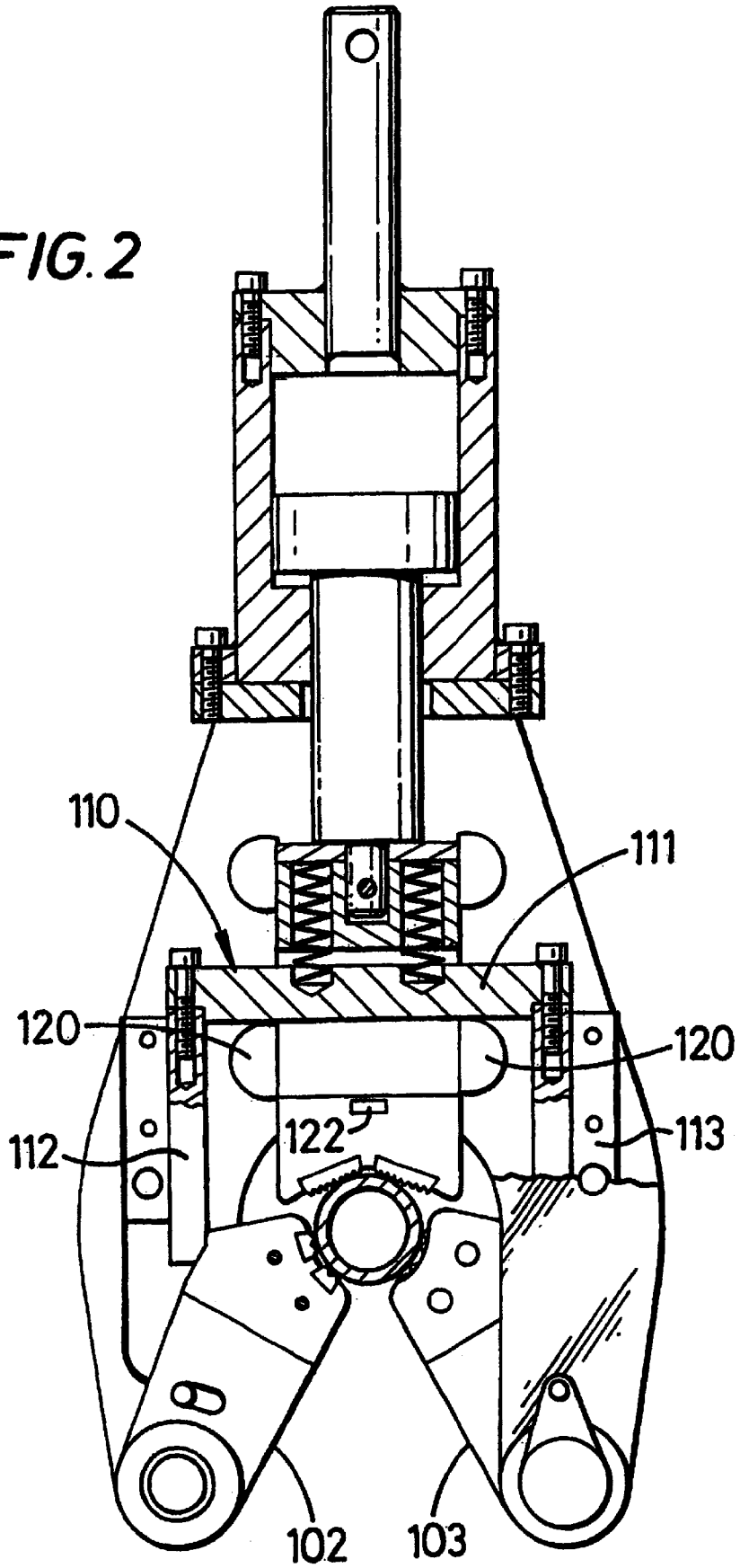

For a better understanding of the present invention reference will now be made, by way of example, to the accompanying drawings, in which:

FIG. 1 is a simplified top plan view, partly in section, of an apparatus in accordance with the present invention about to grip a tubular; and FIG. 2 is a view similar to FIG. 1 but showing the apparatus in gripping engagement with the tubular.

Referring to the drawings, there is shown an apparatus in accordance with the present invention which is generally identified by the reference numeral 100.

The apparatus 100 comprises a housing 101 which accommodates two passive jaws 102, 103 which are pivotally mounted on pivot shafts 104, 105 respectively which extend through the housing 101. The movement of each passive jaw 102, 103 is limited by a pin which is mounted on the housing 101 and which projects into an elongate slot in the passive jaw 102, 103.

Thus, as shown in the drawing, the pivotal movement of the passive jaw 102 is limited by a pin 106 which is mounted on the housing 101 and projects upwardly into an elongate slot 107 in the passive jaw 102.

Each passive jaw 102, 103 is biased inwardly by a leaf spring 108 which is mounted on a guide plate 109 which is bolted to the housing 101.

A yoke 110 which comprises a cross member 111 and two arms 112, 113 is arranged in the housing 101 so that it can be slid between an inoperative position as shown in FIG. 1 and an operative position as shown in FIG. 2 in which the free extremities of the arms 112, 113 prevent the passive jaws 102, 103 pivoting to an open position.

The cross member 111 of the yoke 110 is provided with two recesses which each accommodate one end of a respective spring 114 which is accommodated in a pocket of an active jaw 115 attached to the piston 116 of a hydraulic piston and cylinder assembly 117 which is mounted on the housing 101.

At the start of a gripping operation the components of the apparatus 100 are in the position shown in FIG. 1. The apparatus 100 is then moved towards a tubular 118 to be gripped.

The tubular 118 enters the apparatus 100 through the opening 119. As it does so the passive jaws 102, 103 are displaced to their open position against the bias of the leaf springs 108.

Once the tubular 118 is inside the apparatus the passive jaws 102, 103 spring back into the position shown under the influence of the leaf springs 108.

The hydraulic piston and cylinder assembly 117 is then actuated to extend the piston 116.

As the piston 116 moves towards the tubular 118 the springs 114 displace the yoke 110 until the cross member 111 comes to rest on stops 120. In this position the free extremities of the arms 112 and 113 are immediately behind the passive jaws 102, 103 respectively and inhibit their pivotal movement.

As the piston 116 moves further towards the tubular 118 the springs 114 compress until the teeth 121 on the lower end of the active jaw 115 grip the tubular 118.

As the teeth 121 are applied to the tubular 118, the tubular 118 presses against the passive jaws 102, 103 which attempt to pivot towards their open position. However, this movement is limited by the arms 112, 113 which are in turn supported by the guide plates 109 (FIG. 2).

When it is desired to release the tubular 118 the piston 116 is simply retracted. The teeth 121 move away from the tubular 118 releasing the pressure on the tubular 118 and, in turn, on the passive jaws 102, 103. As the jaws 121 are further withdrawn the compression on the springs 114 reduces.

At this point the yoke 110 may be withdrawn to its inoperative position shown in the drawings. Withdrawal may be achieved by, for example a manually operable handle (not shown) on the cross member 111, a spring (not shown) or, more preferably a projection 122 fast with the active jaw 115 which engages the yoke 110 and physically withdraws it.

At this stage the apparatus 100 can simply be withdrawn from the tubular 118. In particular, as the apparatus 100 is withdrawn the passive jaws 102, 103 will pivot outwardly to allow the tubular 118 to pass through the opening 119.

Whilst the apparatus 100 can be used for gripping a large variety of tubulars it is particularly suitable for functioning as a back-up tong in the running of tubulars, for example casing and drill pipe in the construction of oil and gas wells.

The passive jaws 102, 103 are preferably provided with teeth 121 similar to the active jaws 115. Instead of teeth the jaws 102, 103, 115 may be provided with any other gripping member, for example pads of rubber or similar resilient material designed to facilitate gripping the tubular without impairing the outer surface thereof.

If desired one of the two passive jaws 102, 103 could be fixed. However, this is not recommended.

What is claimed is:

1. An apparatus for gripping a tubular member (118), which apparatus comprises a housing (101) having an opening (119) for receiving a tubular member (118), characterised in that said apparatus (100) further comprises at least one passive jaw (102, 103) pivotally mounted on said housing (101) and pivotable between a first position in which said tubular member (118) can enter said apparatus (100) via said opening (119) and a second position in which exit of said tubular (118) from said apparatus (100) is inhibited, an arm (112, 113) displaceable to prevent said passive jaw (102) pivoting to its first position, an active jaw (115) displaceable into engagement with said tubular member (118), and means (114) which act between said active jaw (115) and said arm (112) so that, in use, when a tubular member (118) is in said apparatus (100) and said active jaw (115) is advanced towards said tubular member (118) said arm (112) is displaced to prevent said passive jaw (102) moving to its first position before said active jaw (115) engages said tubular (118).

2. An apparatus as claimed in claim 1, including means (108) to bias said passive jaw (102) towards said second position.

3. An apparatus as claimed in claim 1, including a pin (106) on one of said housing (101) and said at least one passive jaw (102), and an elongate slot (107) in the other of said housing (101) and said at least passive jaw (102), said pin (106) projecting into said elongate slot (107) and co-operating therewith to limit movement of said at least passive jaw (102) relative to said housing (101).

4. An apparatus as claimed in claim 1, wherein there are two passive jaws (102, 103) pivotally mounted on said housing (101) on opposite sides of said opening (119), each passive jaw (102, 103) being pivotable between a first position in which said tubular member (118) can enter said apparatus (100) via said opening (119) and a second position in which exit of said tubular member (118) from said apparatus is inhibited, an arm (112, 113) associated with each passive jaw (102, 103) and displaceable to prevent its passive jaw (102, 103) pivoting to its first position.

5. An apparatus as claimed in claim 4, wherein said arms (112, 113) form part of a yoke (110).

6. An apparatus as claimed in claim 5, wherein said means which act between said active jaw (115) and said arms (112, 113) comprise at least one spring (114).

7. An apparatus as claimed in claim 1, including a hydraulic piston and cylinder (117) to displace said active jaw (115).

* * * * *